US005358464A

United States Patent [19]

Funk et al.

[11] Patent Number: 5,358,464

[45] Date of Patent: Oct. 25, 1994

[54] CONVEYOR SYSTEM AND MULTI-SPEED FOLDER

[75] Inventors: Warren S. Funk, Chalfont; Mark L. Novack, Cheltenham; Robert S. Ott, Perkasie; James W. Thompson, Horsham, all of Pa.

[73] Assignee: R. Funk & Co., Inc., Doylestown, Pa.

[21] Appl. No.: 999,084

[22] Filed: Dec. 31, 1992

[51] Int. Cl.[5] ..... B31B 1/88; B65G 43/00

[52] U.S. Cl. ..... 493/320; 198/341; 198/577; 493/23; 493/29; 493/416

[58] Field of Search ..... 493/12, 23, 25, 29, 493/320, 416; 198/341, 577; 271/270, 202, 203

[56] References Cited

U.S. PATENT DOCUMENTS

| | | | |
|---|---|---|---|
| 3,363,897 | 1/1968 | Northern et al. | 493/23 |
| 3,404,658 | 10/1968 | French et al. | 198/577 X |
| 3,485,339 | 12/1969 | Miller et al. | 198/577 X |
| 3,692,303 | 9/1972 | Grantham | 493/23 X |
| 3,827,545 | 8/1974 | Buhayar | 271/203 X |
| 3,926,424 | 12/1975 | Gerstenberger et al. | 493/23 X |
| 3,992,182 | 11/1976 | Frank | 198/577 X |
| 4,516,759 | 5/1985 | Kobler | 271/202 X |
| 4,545,780 | 10/1985 | Martin . | |
| 4,573,671 | 3/1986 | Reponty | 493/23 X |
| 4,854,928 | 8/1989 | Fukuyama . | |
| 5,049,227 | 9/1991 | Long et al. | 493/421 X |
| 5,174,229 | 12/1992 | Adamski, Jr. et al. | 271/270 X |

*Primary Examiner*—Edward K. Look
*Assistant Examiner*—John Ryznic
*Attorney, Agent, or Firm*—Gregory J. Gore

[57] ABSTRACT

A compact conveyor which passes sheets from a printer to a folder saves valuable floor space while providing the capability of accommodating a short intercopy gap. Sensing means on the conveyor detects the exit of each sheet from the printer and signals a temporary increase in the speed of the folder to a fast-fold operation. As the next sheet travels behind the faster moving first sheet, the intercopy gap between the sheets increases before the next sheet arrives at the folder. The arrival occurs after the first sheet has been completely folded, since the increased gap has provided sufficient time delay. When the first sheet is released from the folder, the folder speed returns to the original slower speed which is equalized with the printer. By adjusting the rate of the fast-fold mode, the gap between the sheets arriving at the folder can be regulated. Since this compensation for a short intercopy gap is accomplished without changing the speed of the printer or conveyor, it may be universally adapted to a variety of printers.

16 Claims, 9 Drawing Sheets

CONVEYOR SYSTEM AND MULTI-SPEED FOLDER

FIELD OF THE INVENTION

This invention relates to systems for conveying sheets of material, for example engineering prints, and relates especially to conveyor systems for receiving a train of paper sheets and passing them to a folder.

BACKGROUND OF THE INVENTION AND DESCRIPTION OF THE PRIOR ART

Input conveyor systems are known in the prior art which will receive a train of paper sheets of different sizes and pass them to an associated folder (such as an accordion-type folder) which automatically folds them into packets according to a desired folding routine for each size of sheet. U.S. Pat. No. 3,961,781 of Roger S. Funk, issued Jun. 8, 1976, describes such a system, in which the sizes of successive sheets fed into the folder system are automatically sensed on the input conveyor, as by photodetectors, to produce signals representative of the size of each sheet as it enters the folder; these signals are then used to control the subsequent folding action in a manner appropriate to the size of the sheet being folded.

The space between successive sheets leaving the printer in the print/fold process is called the "intercopy gap". Universal-type folders which must adapt to a variety of different printers cannot be used if there is an insufficient intercopy gap. This is often the case because of the inherent difference in mechanics between the printer which is continuous, and the folding machine which must complete its operation on a first sheet before the next sheet is received.

For relatively short sheets, a short intercopy gap may be compensated for by merely increasing the speed of the folder relative to the printer. However, this compensation is not possible with a longer sheet which, while its leading edge is entering the folder, still has its trailing portion constrained by the conveyor system in the printer. When both the printer and folder are operating simultaneously on opposite ends of a relatively longer sheet, the speeds of the printer and the folder must be equal to prevent the buckling or tearing of the sheet. Equalizing the speeds of the printer and folder, however, negates the possibility of simply increasing the folder speed relative to the printer and thus the intercopy gap problem persists.

One solution to this problem is to create a very long paper path in the conveyor between the printer and folder that is greater than the longest printed sheet. Then, since the two machines will never be operating on the same sheet at the same time, the requirement mentioned above for equalizing the speeds is eliminated. By using a very long paper path, a printer intercopy gap which is too short may be compensated for by simply increasing the speed of the folder relative to the printer. Since the print ahead is always moving at a faster speed, the intercopy gap increases to the desired distance as the sheets travel across the conveyor to the folder.

The above solution, however, poses a severe disadvantage; namely, greatly increased floor space required for a very long, flatbed conveyor between printer and folder to provide the long paper path. Floor space occupied by the conveyor may be saved by employing a serpentine paper path, or utilizing a conveyor system which allows the sheet to loosely accumulate between the printer and folder; but these alternatives are inadequate, since accurate control of the position and movement of the sheet is lost. Furthermore, the other benefits of a flatbed, horizontal conveyor which may employ sensors for determining sheet speed, width and length are also forfeited.

BRIEF SUMMARY OF THE INVENTION

To solve the problems of the prior art with printing and folding longer sheets as described above, the present invention has been devised. The invention is based on the observation that printer/folder speed equalization is not necessary during the period beginning when a sheet is released from the printer and ending when the leading edge of the next sheet enters the folder. This observation is true, regardless of conveyor length.

The invention includes means on the conveyor, which senses the exit of a sheet from the printer and signals a temporary increase in the speed of the folder to a fast-fold operation. As the sheets travel across the conveyor, the intercopy gap increases to provide sufficient delay between successive sheets delivered to the folder. When the folded packet of the first sheet is released from the folder, the folder speed is then slowed to its original speed (printer speed). This occurs before the next sheet arrives at the folder, because the temporary speed increase provides sufficient intercopy gap so that folding one sheet is completed before the next arrives. Since this is accomplished without changing the speed of the printer or conveyor, the invention may be universally adapted to printers having different speeds and different intercopy gaps.

The operation of the present invention may be further described as follows. A short, flatbed conveyor of the type well-known in the art includes a horizontal planar bridge, which receives the sheets from a printer and delivers them to a folder. Because of the short distance between the printer and folder, very long sheets are operated on simultaneously by both machines. That is, the front portion of a sheet is being accordion-folded, while the trailing portion of the same sheet is still being printed.

As the trailing edge of the first sheet leaves the printer, a sensor in the conveyor adjacent to the printer signals the folder to temporarily increase its speed to begin a fast-fold mode. By this time, the next sheet is just exiting the printer. Now the conveyance mechanisms within the folding and printing machines are moving the sheets at different speeds, but they are operating on different sheets, and therefore no damage to the sheets is created. As the process continues and the leading edge of the next sheet leaves the printer, it is moving behind the first sheet by a short distance (intercopy gap). As it moves along the conveyor bridge, it falls farther behind the trailing edge of the first sheet because the first sheet is now moving faster. After the entire first sheet has been folded, a controller signals the folder to return to a slow-fold mode of its operation. The front portion of the next sheet now arrives at the folder and begins folding at the same speed as the printer which is still processing the trailing portion of that sheet. Thus, the folder continually cycles between two speeds, slow-fold (printer speed) and fast-fold, at times when printing and folding is not being done on the same sheet. Adjusting the speed of the folder during the fast-fold mode will change the intercopy gap between successive sheets arriving at the folder as desired.

It will be readily understood that with this system, the same sheet is being folded at two different speeds. It has been observed that increasing the folder speed while it is operating on a sheet as described above does not adversely affect the quality of the fold. This is a unique characteristic of the present invention and provides results which are unachievable by any other prior art system.

It is the primary object of the present invention to provide means to alter the spacing between conveyed articles in a sequential processing line when the article is longer than the distance between processing stations.

It is another object of the present invention to provide a folder with an effective system for accommodating a short printer intercopy gap without increasing conveyor length and, thus, unnecessarily wasting valuable floor space.

It is also an object of the present invention to provide a compact, universal conveyor system which operates between a printer and a folder, and also maintains the capability of sensing the velocity, length, width, and position of the sheets leaving the printer.

It is yet another object of the present invention to provide a folder with an automatically actuated speed change to increase the intercopy gap between successive sheets delivered to the folder by the conveyor.

It is a further object of the present invention to provide a folder speed change system and conveyor to compensate for intercopy gaps which also maintain accurate control over the speed and alignment of the sheet so that buckling, wrinkling or tearing of the sheet is avoided.

Other objects, advantages and novel features of the invention will become apparent from the following detailed description of the invention when considered in conjunction with the accompanying drawings herein.

DESCRIPTION OF THE PREFERRED EMBODIMENT

Figure 1:
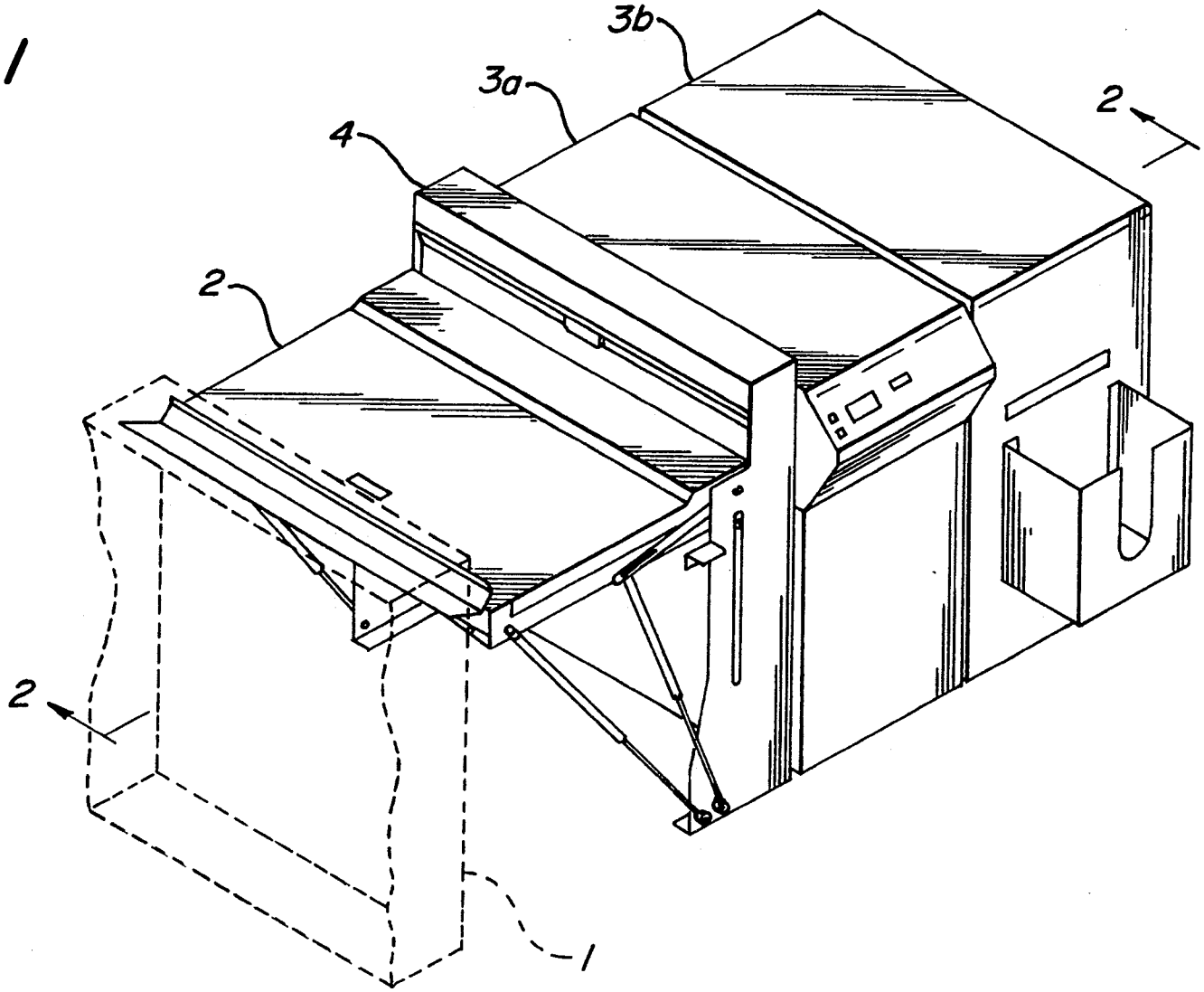
FIG. 1 is an isometric view of the present invention positioned in association with a printer which is shown in phantom.

Referring now to FIG. 1, the present invention is shown in association with a printer depicted in phantom. A conveyor assembly 2 forms a bridge and receives sheets from a printer 1 and passes them on to folders 3*a* and 3*b*. Folders 3*a* and 3*b* are free-standing units which are close together so that a partially folded packet passes from folder to folder through the small vertical space which separates them. In the preferred embodiment, folder 3*a* is an accordion-type folder which passes its folded packet to the second folder 3*b* which is a cross-folder. Details of the cross-folder form no part of the present invention and it is shown in this figure merely to illustrate the typical environment in which the present invention operates.

Figure 2:
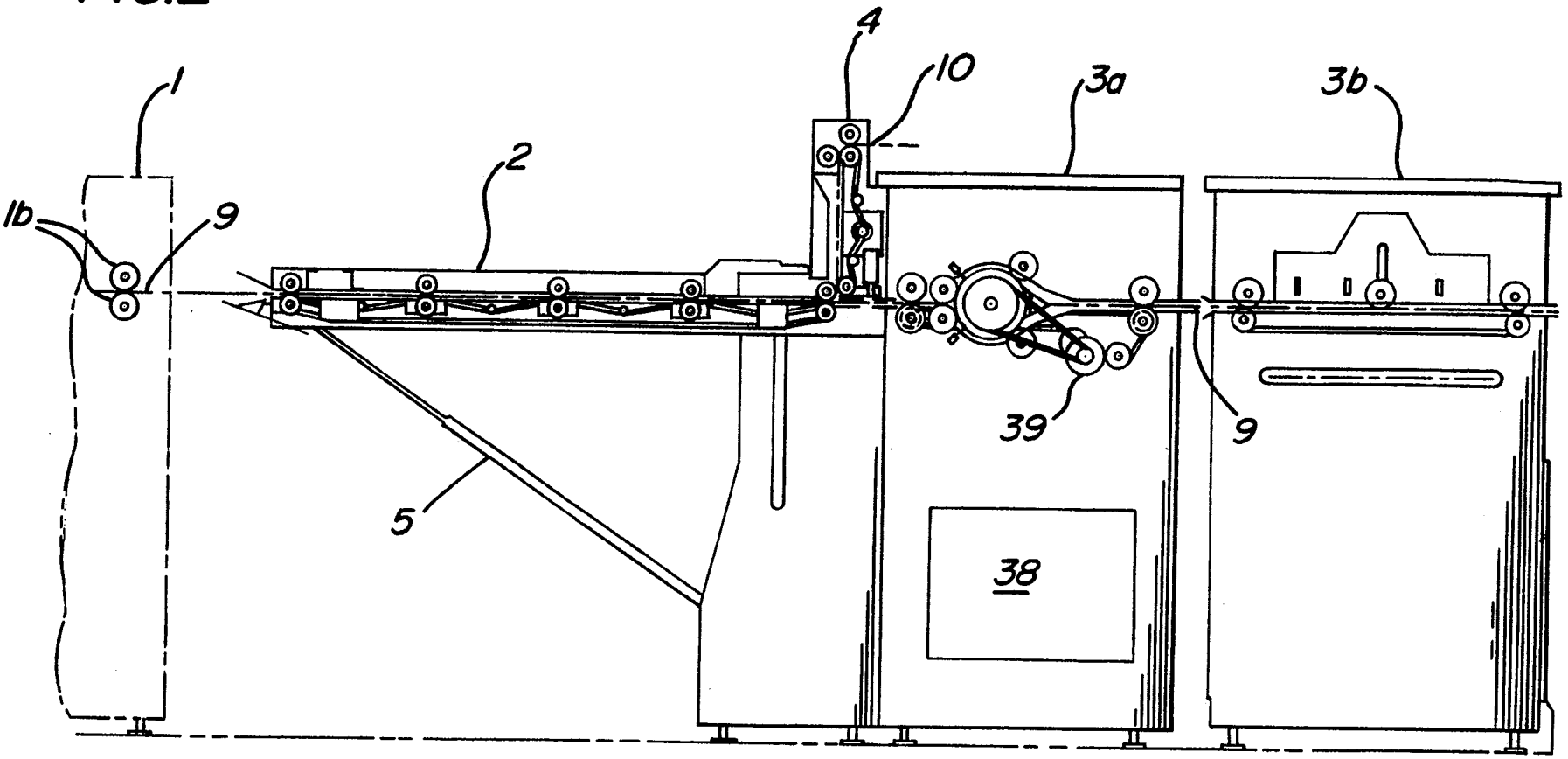
FIG. 2 is a side sectional view taken from FIG. 1 showing the paper path between the printer, conveyor, and folders.

Referring now to FIG. 2, a side sectional view taken from FIG. 1 is shown. The paper path 9 is substantially horizontal and moves from printer 1 through the conveyor bridge 2 which extends between the printer and folder 3*a*. Paper sheets are moved through the printer by drive rollers 1*b*. Adjustable support member 5 varies the height of the end of the conveyor bridge so that the mouth of the conveyor is in alignment with the output chute of the printer. The conveyor bridge is directly affixed to the side of accordion folder 3*a* and includes a sheet diverter mechanism 4, which provides alternate paper path 10. The diverter mechanism directs paper sheets away from the folders when a jam condition is detected or when flat stacking is desired. A controller 38 within the folder is signalled by conveyor bridge sensors and regulates the folder motor 39.

Figure 3:
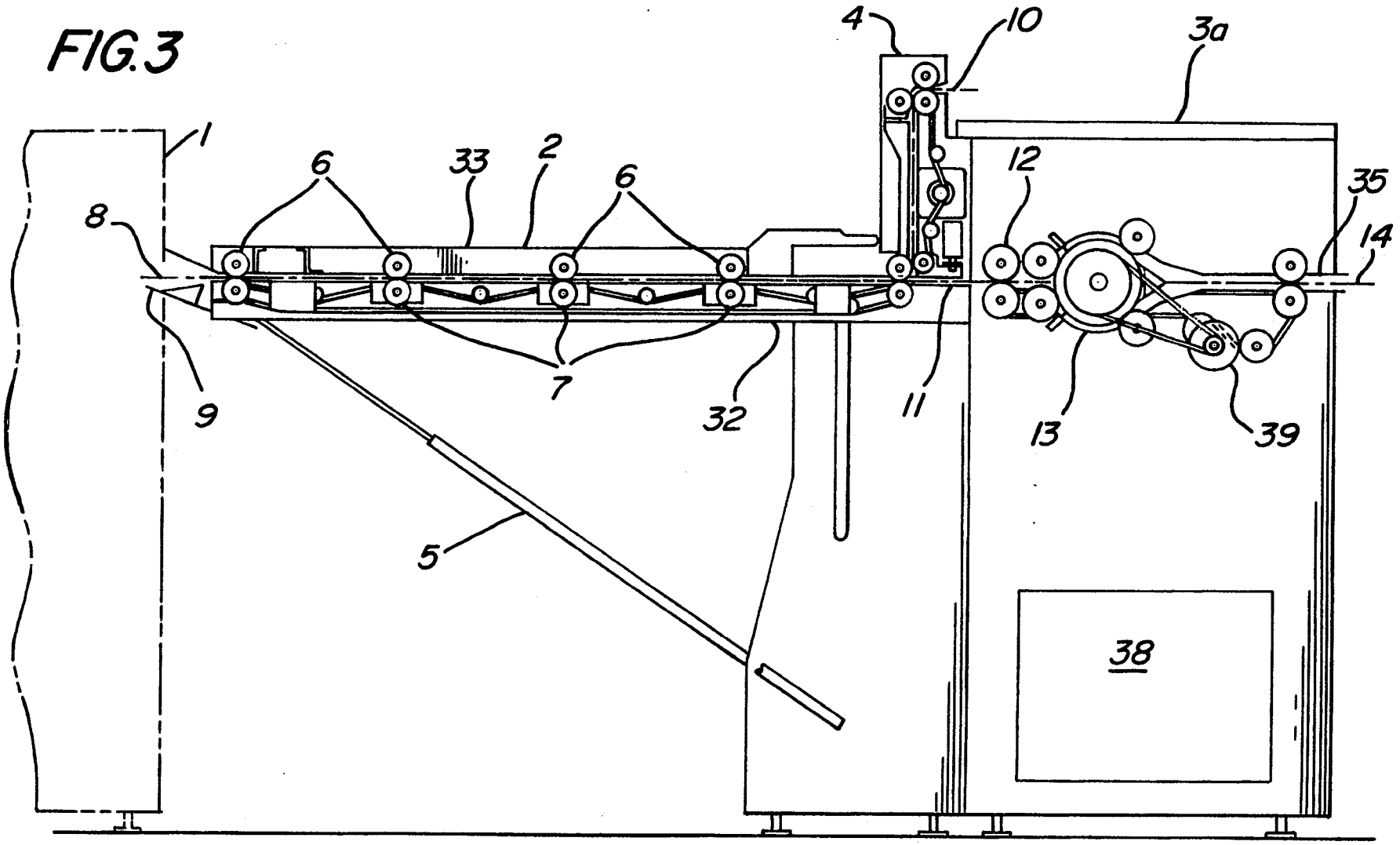
FIG. 3 is an enlarged, side sectional view of the conveyor bridge and accordion folder.

FIG. 3 shows greater detail of the side sectional view shown in FIG. 2. The paper sheets processed by the present invention enter the conveyor bridge mouth 8 and follow path 9. The speed and position of the sheet after it leaves the printer is controlled by pairs of opposed rollers which create a nip through which each sheet passes. The rollers include lower drive rollers 7 which are affixed to the conveyor frame 32, and spring-biased top idler rollers 6 which are mounted to the conveyor cover 33. As each sheet passes from the conveyor bridge into folder 3*a*, it is moved through the folder by internal positive drive rollers 12. In the preferred embodiment, folder 3*a* is an accordion-type folder, including folding drum 13 which reciprocates in a manner well-known in the art to create the desired accordion folding of the sheet. The folding drum is driven by motor means 39 which includes shaft position sensing means, such as a rotary encoder. Alternatively, the motor means may be a stepper-type motor. In either case, there is further included communication means between the motor and the controller so that the controller possesses data which indicates the motor shaft position.

Figure 4:
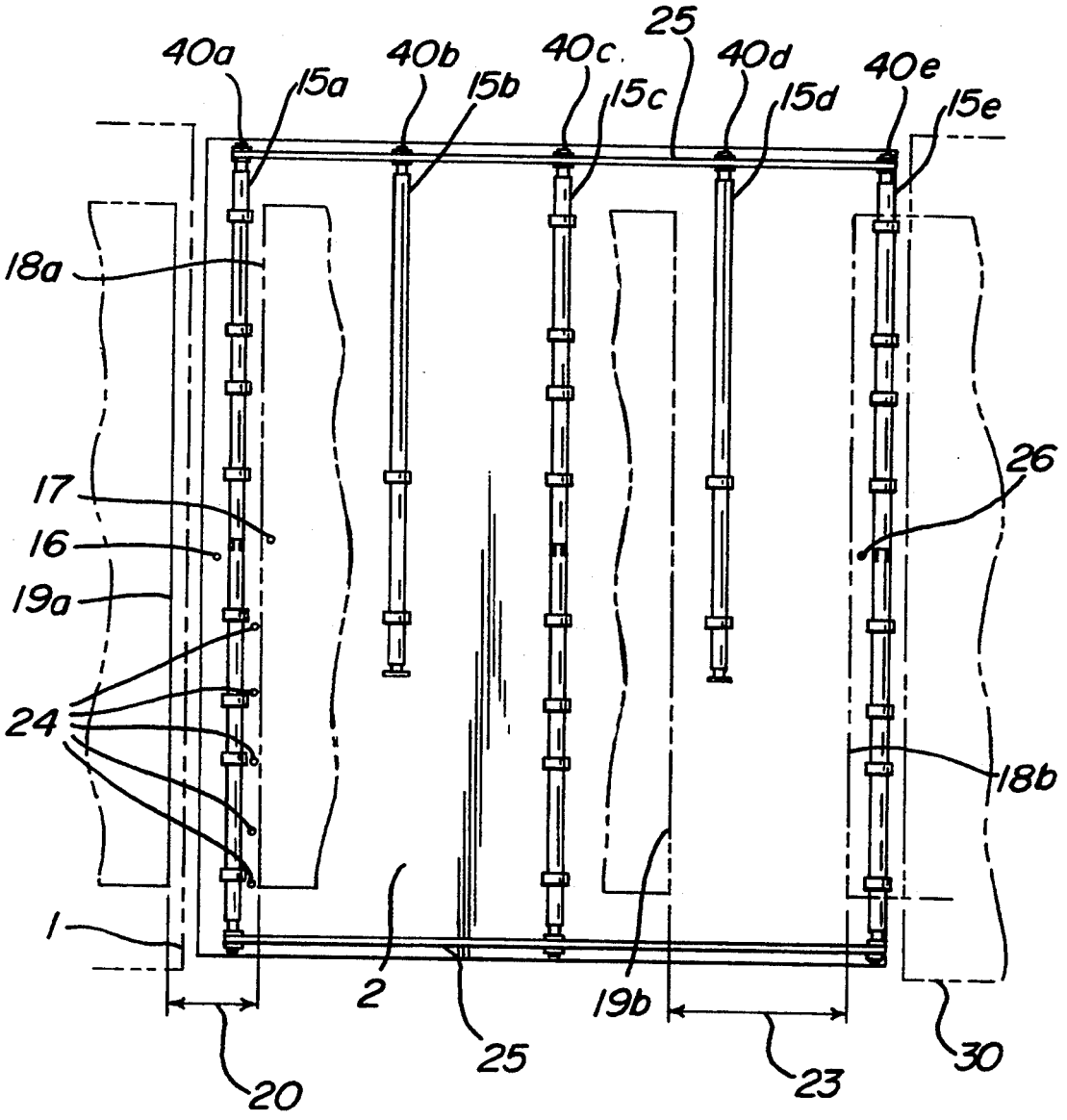
FIG. 4 is a top view of the conveyor bridge.

Referring now to FIG. 4, a top view of the conveyor bridge is shown. The conveyor includes drive shafts 15*a, b, c, d* and *e* which are rotatably affixed to the conveyor bridge frame and are positioned horizontally beneath the top of the frame which forms the bed of the conveyor. The shafts are driven by belts 25. Each drive shaft contains a plurality of rollers 7 along its length, which extend through apertures in the bed to contact the underside of the sheets. Pulleys 40*a* at either end of the first drive shaft 15*a* are rigidly fixed. Pulleys 40*b, c, d* and *e*, however, are affixed to the ends of the other drive shafts 15*b, c, d* and *e* through one-way clutching mechanisms interposed between the shafting and the pulleys. Greater detail of the clutching of these pulleys and its importance to the invention will be more fully described herein with reference to FIGS. 5 and 6.

The conveyor bed of FIG. 4 includes a plurality of sensors which are connected to the operation controller. Sensors 24 function to indicate the width of the conveyed sheet. Sensor 16 is located at the mouth of the bridge and indicates the entry of a sheet and, among other functions, operates to power up the conveyor and the folders. Various types of sensors known in the art may be used, however, the preferred embodiment employs photodetectors. Sensor 16 is positioned just upstream of the first drive shaft. This sensor is critical to the operation of the invention and is connected to the controller to determine the times when the leading and trailing edges of a sheet pass over it.

A pair of sheets shown entering and leaving the conveyor are depicted in cutaway in FIG. 4. At the entry of the conveyor bridge, the trailing edge of a first sheet is shown by edge 18*a*. Following it by a distance 20 is the leading edge of the next sheet leaving the printer indicated by edge 19*a*. When edge 18*a* passes sensor 16, the speed of the folder increases and pulls the first sheet forward at a faster rate. These trailing and leading edges are shown after they have advanced to the end of the conveyor bridge, as edges 18*b* and 19*b* respectively. As shown, the initial intercopy gap 20 between edges 18*a* and 19*a* has increased in length to distance 23 between edges 18*b* and 19*b*. The gap increases because the speed of the first sheet has increased and now it is traveling faster than the next sheet, which is still traveling at the slower printer speed.

Figure 5:
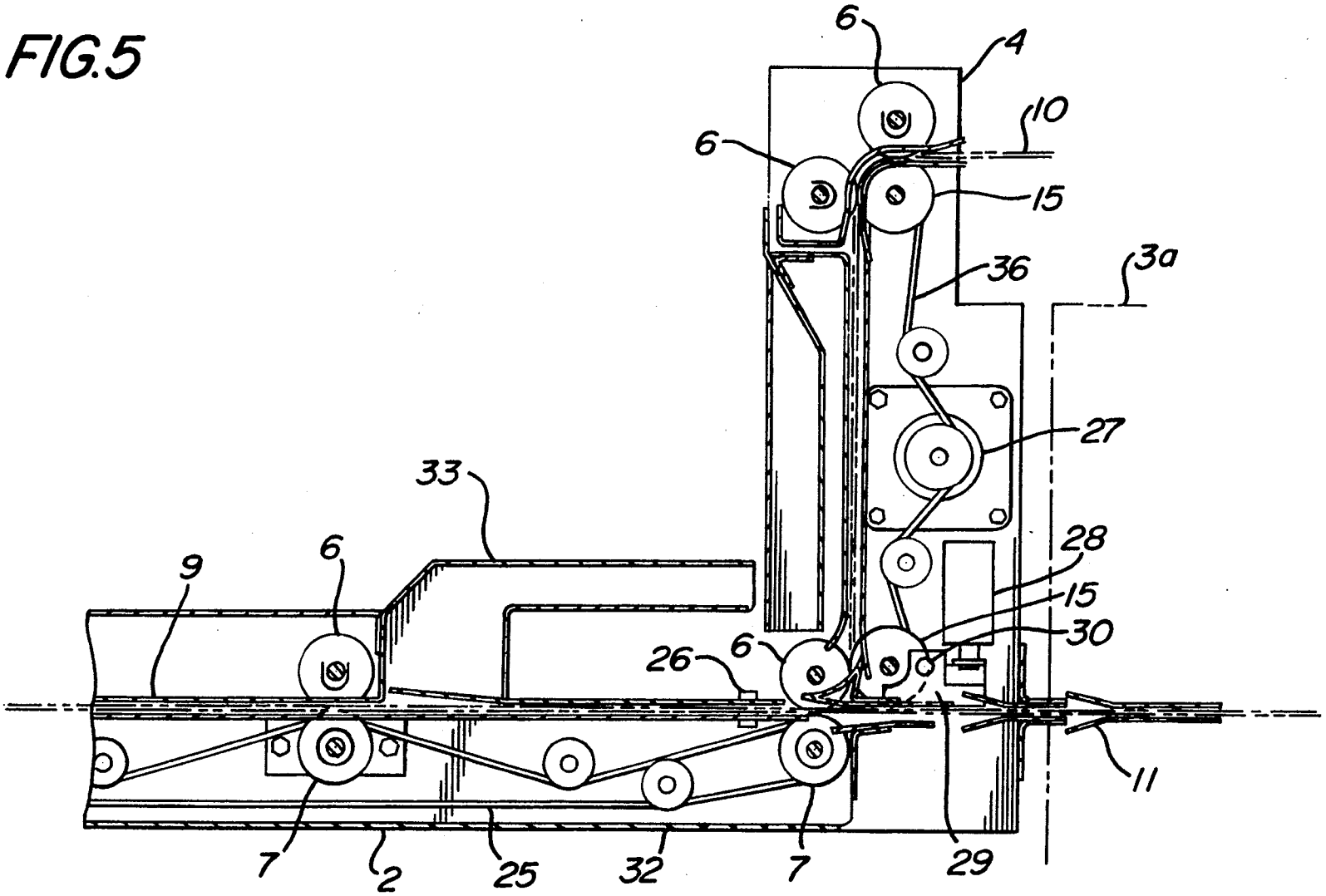
FIG. 5 is an enlarged, side sectional view of the diverter portion of the conveyor bridge.

Referring now to FIG. 5, greater detail of the conveyor bridge exit and the diverter mechanism is shown. The conveyor bridge includes a lower frame 32 which supports all of the drive rollers identical to roller 7 and all are driven through shafting and pulleys by belt means 25. Spring-biased idler rollers 6 press against the drive rollers, creating a forcible nip which drives the paper sheet along path 9. Similarly, diverter mechanism 4 includes drive rollers 15 with opposing idler rollers 6 which direct any diverted sheets along path 10. The drive rollers in the diverter are driven by belt means 36 which is connected to motor 27. The diverter operates to redirect sheets leaving the conveyor bridge so that they bypass the folder in the event of a folder jam. Sensor means 26 located on the conveyor bridge detects the jam condition and activates solenoid 28 which pivots bypass plate 29 about pin 30 downward into the paper path. The edge of the next sheet is directed upward by plate 29 along path 10 away from the folder. The diverter may also be manually activated by the operator if flat sheet stacking is desired.

Figure 6:
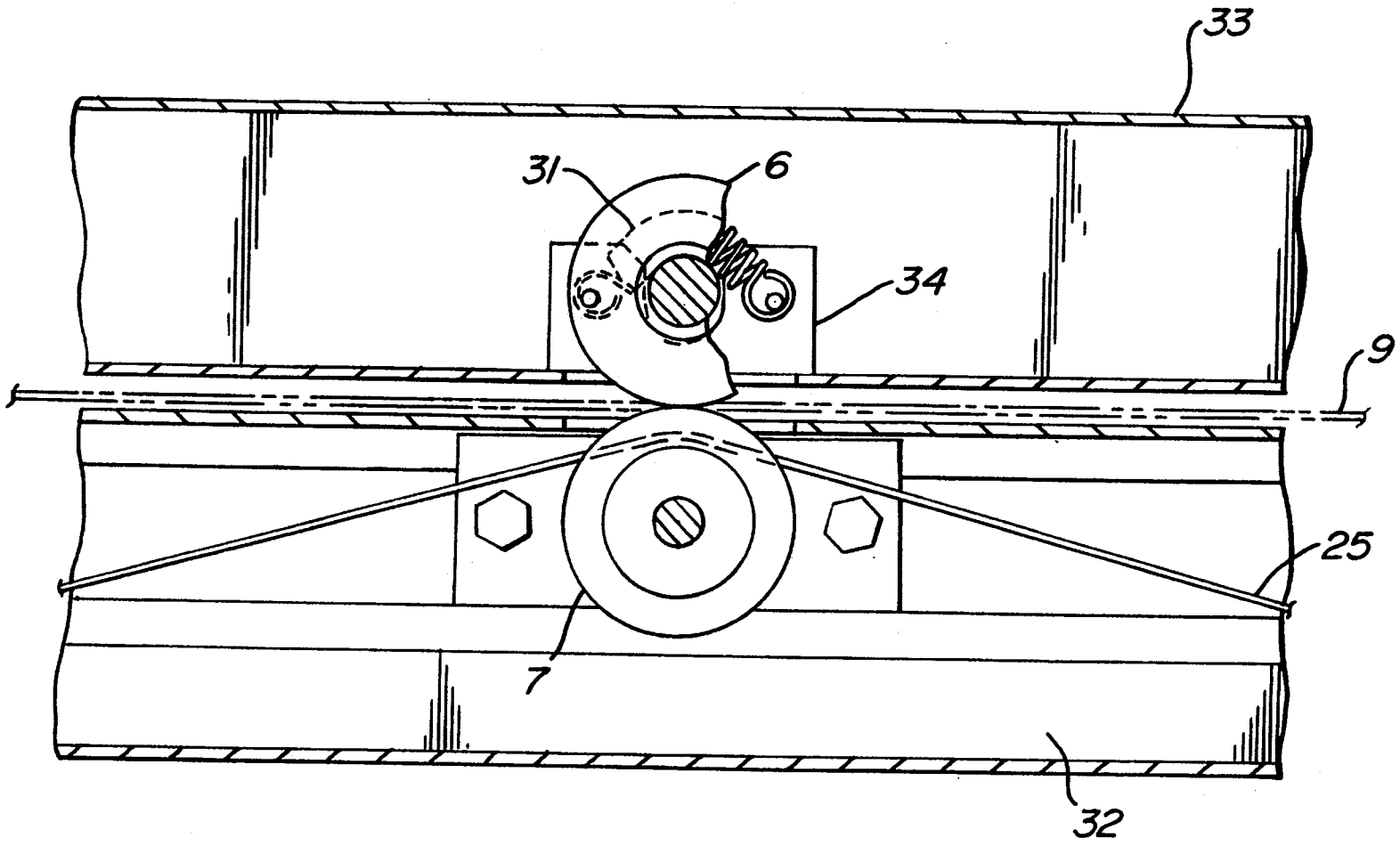
FIG. 6 is a sectional side view of a pair of conveyor rollers.

Referring now to FIG. 6, greater detail of the conveyor bridge drive rollers is shown. The drive rollers are supported by bridge frame 32, while opposing idler rollers 6 are supported by the conveyor cover 33. Each of the idler rollers is affixed to the conveyor cover by a bearing block 34 which provides each idler roller axle with a vertical freedom of movement. Spring means 31 bias each axle in the downward direction, thereby creating a forcible nip against each opposing lower drive roller 7.

Figure 7:
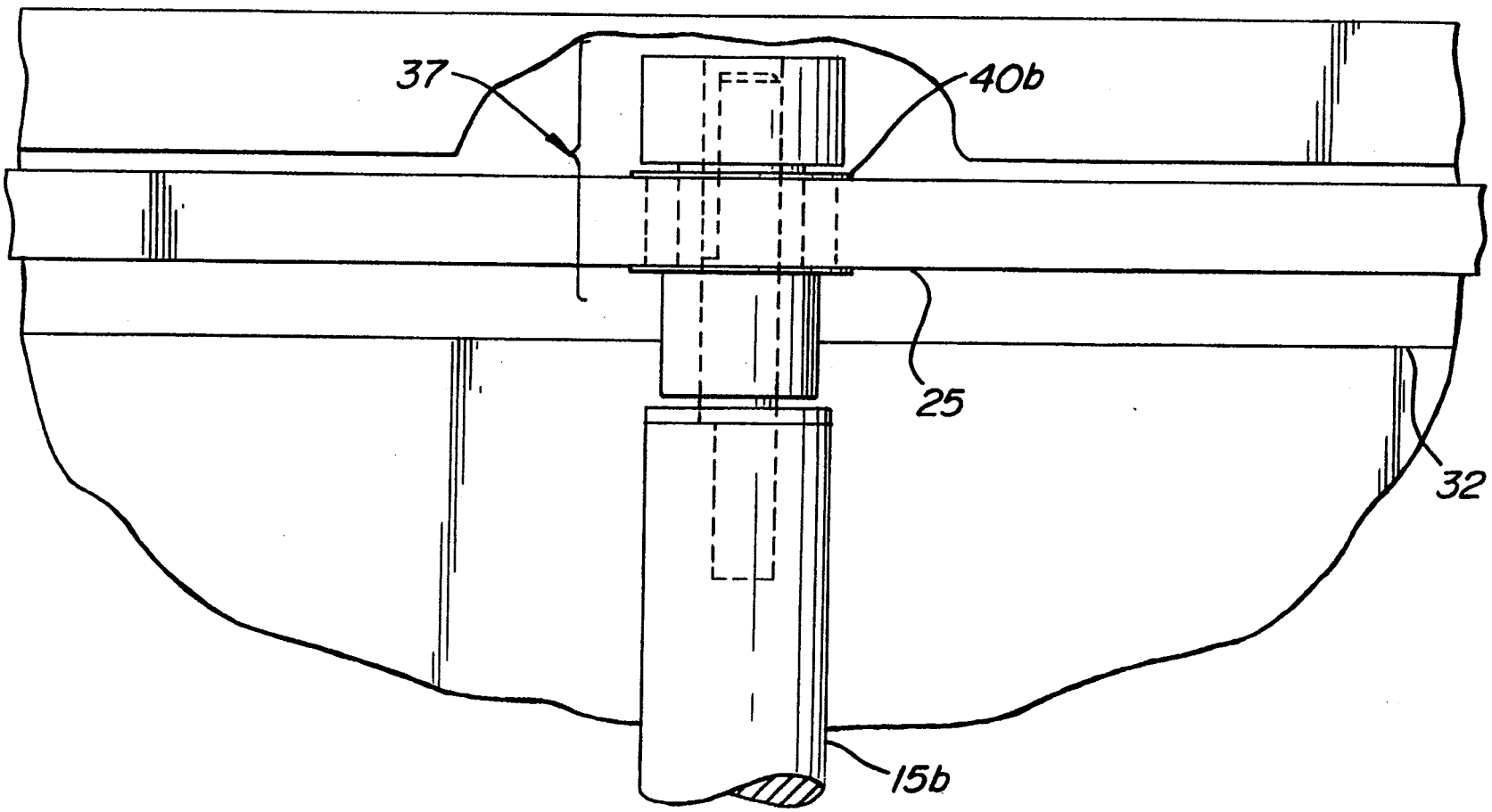
FIG. 7 is a top view of one of the conveyor bridge drive shafts and clutch assembly mechanisms.

Referring now to FIG. 7, detail of one drive shaft clutch mechanism is shown. Pulley 40*b* at the end of shaft 15*b* is identical to pulleys located at the ends of drive shafts 15*c, d* or *e* of FIG. 4. All of these drive shafts on the conveyor bridge are driven at the slow constant speed of the printer, however, they are unidirectional and free to rotate in the forward direction (i.e. may be overdriven). One of these clutches is shown as mechanism 37. Power through each clutch is provided by drive belt 25 and, in this figure, pulley 40*b* drives shaft 15*b*.

As each successive sheet is gripped by the conveyor bridge rollers, it is moved forward slowly until it is pulled by the folder more quickly during the fast-fold operation of the folder because the clutch free-wheels in this direction. This permits the sheets to travel at different speeds across the conveyor bridge, while their alignment remains positively controlled by the rollers. This is a critical feature of the invention which permits the fast-fold portion of the operating cycle of the folder to draw the sheet faster through the drive roller nips than their normal drive speed without tearing, distorting, or misaligning the sheet.

Figure 8:
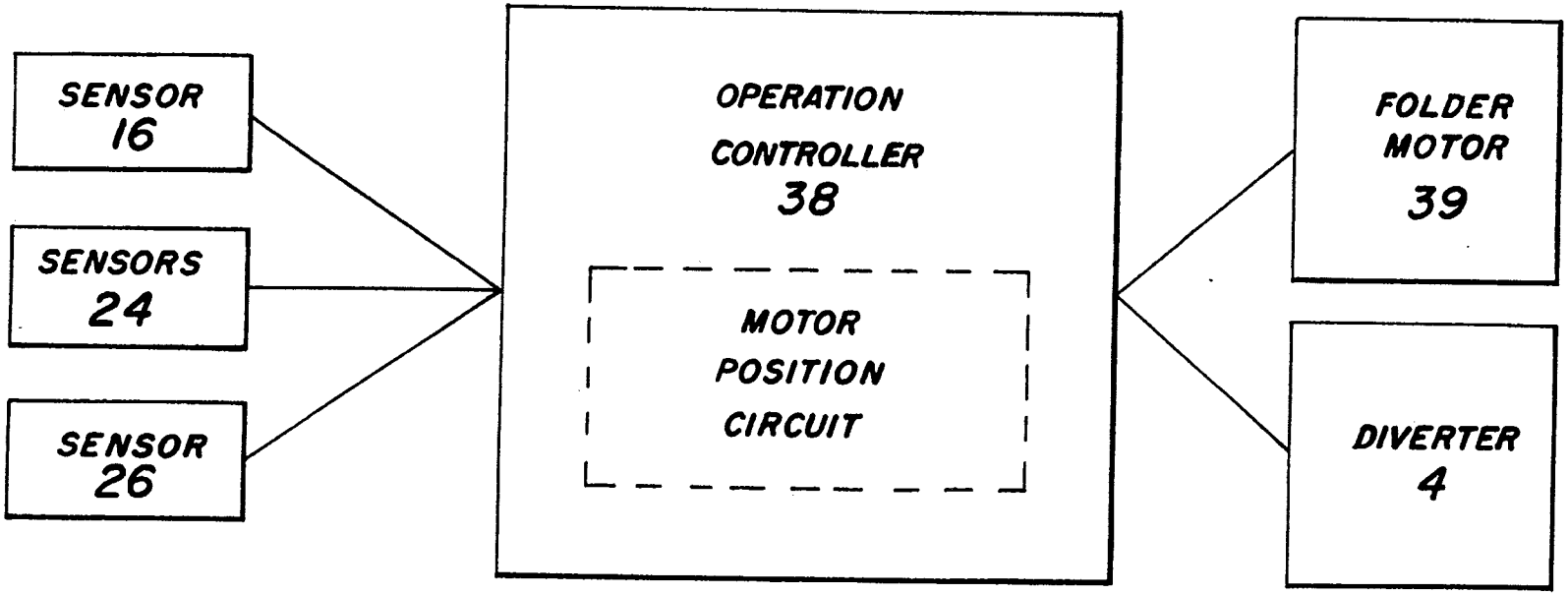
FIG. 8 is a diagram showing the relationships between the sensors, the controller, and the folder.
Figure 9:
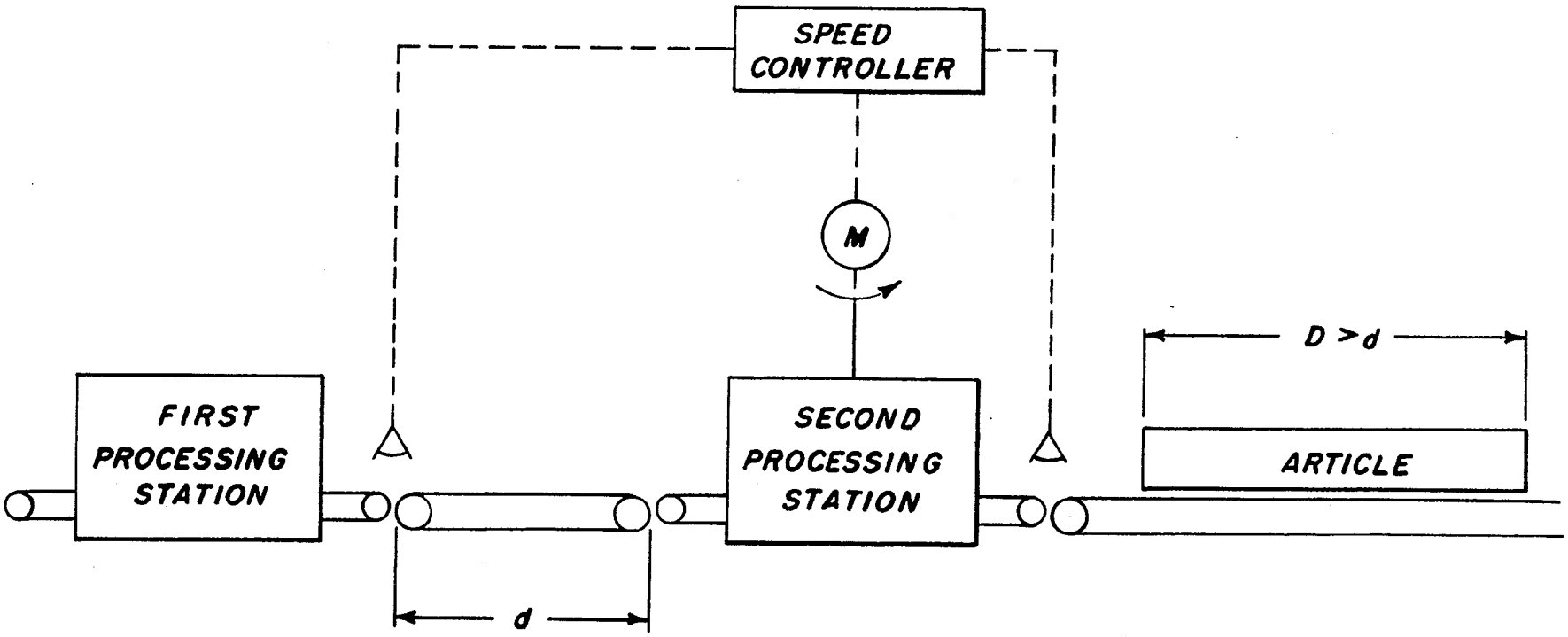
FIG. 9 is a diagram showing the relationship between the length of the article and the distance between processing stations.

Referring now to FIG. 8, a simple diagram of the interconnection between the sensors and the operation controller is shown. The folder speed changes are signaled by sensor 16, which as shown in FIG. 4 is positioned just upstream of the first conveyor drive shaft. This sensor detects passage of the leading and trailing edges of each sheet. The controller further includes a circuit which contains data indicative of the folder motor shaft position.

The controller determines when to change the folder speed as follows. Prior to start-up, the slow speed is adjusted to match the speed of the printer, and the fast speed is adjusted according to the length of folder intercopy gap increase desired. Next, the length of the sheet passing into the folder is calculated by the controller by measuring the time when the leading and trailing edges pass over sensor 16. By comparing this time to the conveyor speed, which is inputed into the controller either through a separate sensor or manual data entry, the sheet length is determined. Then, the controller computes the number of folder motor revolutions which are required to complete the folding of a sheet this length. This provides the anticipated motor position at the packet release point, which is when the sheet is completely folded and released from the folder. Once the folder motor has turned the pre-determined number of revolutions to achieve packet release, the controller reduces the folder speed from the fast/fold mode to the original speed of the folder. Hence, the folder speed change is synchronized with the release of the packet from the folder. The folder motor shaft position may be determined by the controller either from motor shaft position indicating means, such as a shaft-mounted rotary encoder well-known in the electrical arts or by counting the electrical drive pulses sent to a stepper-type folder motor.

Although the preferred embodiment described above utilizes a controller having programming which regulates the folder speed change by motor shaft position, other means well-known in the art may be used to determine the packet release point when the folder is to be returned to its slower operating speed. For example, a sensor may be placed at the folder exit to determine when the packet has passed out of the folder mechanism. The controller may be of any type well-known in the electrical arts, which include adjustment means to change the electrical supply to the folder motor to adjust the levels of both folder speeds. It will be readily understood that as the fast-fold speed of the folder is increased, the intercopy gap between the sheets will likewise be increased. Hence, by changing the controller programing, which regulates folder speed, the intercopy gap may be regulated.

Thus, the objects of the invention have been achieved. A novel system has been devised to regulate the spacing of articles along a processing line where the article is longer than the distance between the processing stations. In particular, applying this device to the print/fold process, small intercopy gaps between relatively long printed sheets can be accommodated by the universal conveyor/folder system of the present invention without wasting valuable floor space. Furthermore, the pre-folding sheet size detection capability of a flatbed-type conveyor has been retained.

It should be understood that the above description discloses specific embodiments of the present invention and is for purposes of illustration only. There may be other modifications and changes obvious to those of ordinary skill in the art which fall within the scope of the present invention which should be limited only by the following claims and their legal equivalents.

What is claimed is:

1. A conveyor and sheet folder, comprising:
- a printer;
- a conveyor for passing a series of separate sheets from said printer to a folder, said conveyor having an entry and an exit;
- a folder having an entry and an exit and at least two speeds of operation, fast and slow, the entry of said folder located adjacent said conveyor exit for receiving said separate sheets therefrom and for folding them;
- first indicating means signalling when said sheets leave the printer;
- second indicating means for signalling when said sheets are released from said folder; and
- a controller connected between both of said indicating means and said folder which changes the folder speed from said slow speed to said fast speed when said sheet is released from said printer, and returns said folder to said slow speed when said sheet is released from said folder.

2. The conveyor and sheet folder of claim 1, wherein said first indicating means detects the trailing edges of said sheets as they pass.

3. The conveyor and sheet folder of claim 2, further including means within said controller for adjusting said fast speed of said folder.

4. The conveyor and sheet folder of claim 1, further including a plurality of unidirectional drive rollers affixed to said conveyor which control the speed of the sheet across a bed of the conveyor, said rollers positioned in opposing pairs creating a forcible nip which holds said sheet, said rollers positively driven in the forward direction, but being freely rotatable in the forward direction, such that said sheet is pulled forward by said folder during said fast speed without resistance at a speed greater than the forward driving speed of said rollers.

5. The conveyor and sheet folder of claim 4, wherein said sheet is longer than the conveyor path between the printer and the folder.

6. The conveyor and sheet folder of claim 5, further including a diverter located at said conveyor exit, whereby sheets exiting said conveyor may be selectively prevented from entering said folder.

7. The conveyor and sheet folder of claim 6, wherein said sensors are photodetectors.

8. The conveyor and sheet folder of claim 7, wherein said folder is an accordion folder.

9. The conveyor and sheet folder of claim 8, further including a plurality of sensors affixed to the conveyor bed which measure the width of the sheet.

10. The conveyor and sheet folder of claim 9, further including sensing means located on said conveyor at said conveyor exit, said sensing means connected to said controller for activating said diverter.

11. A printer and folder, comprising:
- a printer and a folder for sequentially processing a series of paper sheets;
- a conveyor having a paper path and being located between said printer and said folder;
- a first sheet of said paper sheets for processing by said printer and said folder which is longer than said conveyor paper path;
- first indicating means which detects when said first sheet is released from the printer;
- second indicating means which detects when said sheet is released from the folder; and
- a controller connected to said first and said second indicating means, said controller electrically connected to said folder whereby the speed of said folder is increased to a second speed greater than an original operating speed when signalled by said first indicating means, and said folder is then returned to said original operating speed when signalled by said second indicating means.

12. A sequential processing system for a series of separate articles, comprising:
- first and second processing stations located adjacent to each other along a processing line;
- an article being one of said series of articles for processing by said first and said second processing stations, said article moved along a path within each of said processing stations by separate motive means at each station;
- conveyor means located between said first and said second processing stations for transporting processed articles from said first processing station to said second processing station, said conveyor means having a conveyance path which is shorter than the length of said article;
- means for automatically increasing the speed of said motive means at said second processing station from an original speed after said article has exited said first processing station; and
- means for automatically decreasing the speed of said motive means at said second processing station to said original speed when said article has exited said second processing station, whereby the distance between said series of articles is greater at said second processing station than at said first processing station.

13. The processing device of claim 12, wherein said first station is a printer.

14. The processing device of claim 13, wherein said second station is a folder.

15. The processing device of claim 14, wherein said article is a flexible sheet of material.

16. The processing device of claim 15, wherein said article is a paper sheet.

* * * * *